US009609423B2

(12) United States Patent
Montazemi et al.

(10) Patent No.: US 9,609,423 B2
(45) Date of Patent: Mar. 28, 2017

(54) NOISE ABATEMENT SYSTEM FOR DENTAL PROCEDURES

(71) Applicants: Peman Montazemi, Aliso Viejo, CA (US); Shaghayegh Zekavati, Aliso Viejo, CA (US); Massimo Mitolo, Aliso Viejo, CA (US)

(72) Inventors: Peman Montazemi, Aliso Viejo, CA (US); Shaghayegh Zekavati, Aliso Viejo, CA (US); Massimo Mitolo, Aliso Viejo, CA (US)

(73) Assignee: Volt Analytics, LLC, Aliso Viejo, CA (US)

( * ) Notice: Subject to any disclaimer, the term of this patent is extended or adjusted under 35 U.S.C. 154(b) by 22 days.

(21) Appl. No.: 14/495,906

(22) Filed: Sep. 25, 2014

(65) Prior Publication Data

US 2015/0304761 A1 Oct. 22, 2015

Related U.S. Application Data

(60) Provisional application No. 61/883,199, filed on Sep. 27, 2013.

(51) Int. Cl.
*H04R 1/10* (2006.01)
*G10K 11/16* (2006.01)

(52) U.S. Cl.
CPC ..... *H04R 1/1083* (2013.01); *G10K 11/16* (2013.01); *G10K 2210/116* (2013.01);
(Continued)

(58) Field of Classification Search
CPC .. H04R 1/1083; H04R 1/1025; H04R 1/1041; H04R 5/00; H04R 5/033;
(Continued)

(56) References Cited

U.S. PATENT DOCUMENTS 2,527,656 A * 10/1950 Reinsdorf ..... A47C 1/10 297/217.4
2,629,023 A * 2/1953 La Fitte ..... H04M 1/05 297/217.4

(Continued)

FOREIGN PATENT DOCUMENTS

DE 102007054051 A1 5/2009
EP 0438384 A1 7/1991

(Continued)

OTHER PUBLICATIONS

Hearing Problems Among Dental Personnel, Khalid A. Al Wazzan et al., JPDA vol. 14 No. 4 Oct.-Dec. 2005.

*Primary Examiner* — Leshui Zhang
(74) *Attorney, Agent, or Firm* — Knobbe, Martens, Olson & Bear LLP

(57) ABSTRACT

A noise abatement system for dental procedures conceived to protect the hearing of dental staff members composed of office managers, dental operators including at least one of dentist, dental hygienist, dental assistant, dental technician and any other dental staff member in the dental operatory, and of patients, comprises a pair of headphones composed of one left and one right phones [1] connected to each other via a flexible strap [2], an audio signal processor (ASP) [7] with a receiver [17] and an on/off talk button [13] with a transmitter and circuitry [21]. Dental operators and patients can toggle an operator/patient switch [8] in a water- and dust-resistant casing of the pair of headphones to switch between operator mode and patient mode. In operator mode, the ASP receives the audio signals captured from the surrounding environment by one left and one right microphones [3], processes the captured audio signals and sends audible speech frequencies to the ears through one left and one right speakers [4] mounted in the casing of the one left and one
(Continued)

Front View of the Pair of Headphones right phones, while actively abating [15] the high-frequency noise generated by dental tools. In patient mode, the ASP is turned off and the sounds from the surrounding environment are passively abated by the water- and dust-resistant casing, the high-frequency insulating material [6] inside the water- and dust-resistant casing and the cushion [5]; however, if any of the dental operators or the patient enables a talk button [19] belonging to the on/off talk button, the patient will be able to hear speech frequencies from any operator in the surrounding environment and vice versa. Thus, a high-frequency noise-abating system is provided to dental facilities, practitioners and technicians that prevents dental staff members, as well as patients, from being exposed to unwanted noise generated by dental tools. At the same time, dental staff members can communicate among each other during the dental procedure, or operation of dental tools, while the pair of headphones is functioning; dental operators can also communicate with the patient by pushing the talk button. This system also allows each dental staff member and patient to mix in auxiliary audio signals including at least one of music, soothing sounds, white noise, radio, TV and/or any audio signal generated by an external audio source [14]; when in patient mode, this auxiliary audio signal gets muted when any dental operator or patient pushes the talk button in order to have a conversation with each other.

18 Claims, 4 Drawing Sheets

(52) U.S. Cl.
CPC .... *G10K 2210/3224* (2013.01); *H04R 1/1008* (2013.01); *H04R 1/1025* (2013.01); *H04R 1/1041* (2013.01)

(58) Field of Classification Search
CPC .. H04R 2420/07; H04R 2430/01; H04R 1/26; H04R 1/403; H04R 3/04; H04R 3/12; H04R 3/14; H04R 25/00; H04R 25/40; H04R 25/402; H04R 25/405; H04R 25/407; H04R 25/43; H04R 25/50; H04R 25/502; H04R 25/505; H04R 25/507; H04R 25/55; H04R 25/552; H04R 25/554; H04R 25/556; H04R 25/558; H04R 25/35; H04R 25/353; H04R 25/356; H04R 25/45; H04R 25/453; H04R 25/456; H04R 25/60; H04R 25/65; H04R 25/602; H04R 25/652; H04R 25/654; H04R 25/656; H04R 25/658; H04R 1/10; H03G 3/32; H03G 5/00; G10K 11/002; G10K 11/1788; G10K 2210/116; G10K 2210/3222; G10K 2210/3027; G10K 2210/3046; G10K 2210/3026; G10K 11/1784; G10K 2210/3032; G10K 2210/3045; G10K 2210/51; G10K 2210/511; G10K 2210/512; G01H 3/14; A61B 5/0002; A61B 5/121; A61F 2011/145; A61F 11/06; H04S 1/005; H04S 7/307
USPC ..... 381/74, 73.1, 72, 26, 56, 57, 60, 71.6, 381/71.7, 71.11, 71.12, 71.1, 119, 381/120–123, 312, 313, 314, 315, 316, 381/317, 318, 320, 321, 322, 323, 328, 381/329, 331, 23.1; 700/94; 455/569.1, 455/569.2, 570, 575.1, 575.2; 297/217.4
See application file for complete search history.

(56) References Cited

U.S. PATENT DOCUMENTS

| | | | | | |
|---|---|---|---|---|---|
| 2,986,140 | A * | 5/1961 | Gardner | A61C 1/081 | 331/78 |
| 4,082,918 | A * | 4/1978 | Chang | A61C 19/00 | 381/109 |
| 4,977,600 | A | 12/1990 | Ziegler | | |
| 5,133,017 | A * | 7/1992 | Cain | G01R 33/3854 | 381/71.4 |
| 5,692,056 | A * | 11/1997 | Gardner | G10K 11/1788 | 381/71.2 |
| 5,737,433 | A * | 4/1998 | Gardner | H04R 3/00 | 381/71.1 |
| 6,118,878 | A | 9/2000 | Jones | | |
| 6,466,673 | B1 * | 10/2002 | Hardy | G10K 11/1784 | 381/71.2 |
| 6,728,385 | B2 | 4/2004 | Kvaløy et al. | | |
| 6,738,482 | B1 | 5/2004 | Jaber | | |
| 6,975,158 | B2 | 12/2005 | Sekimoto | | |
| 7,003,099 | B1 | 2/2006 | Zhang | | |
| 7,171,008 | B2 | 1/2007 | Elko | | |
| 7,215,766 | B2 | 5/2007 | Wurtz | | |
| 7,246,058 | B2 | 7/2007 | Burnett | | |
| 7,277,722 | B2 | 10/2007 | Rosenzweig | | |
| 7,403,608 | B2 | 7/2008 | Auvray | | |
| 7,415,372 | B2 | 8/2008 | Taenzer | | |
| 7,817,803 | B2 | 10/2010 | Goldstein | | |
| 7,970,159 | B2 | 6/2011 | Kleinschmidt | | |
| 8,073,150 | B2 | 12/2011 | Joho | | |
| 8,077,874 | B2 | 12/2011 | Sapiejewski | | |
| 8,130,987 | B2 | 3/2012 | Kaneda | | |
| 8,189,803 | B2 | 5/2012 | Bergeron | | |
| 8,194,873 | B2 | 6/2012 | Pan | | |
| 8,218,784 | B2 | 7/2012 | Schulein | | |
| 8,315,400 | B2 | 11/2012 | Goldstein | | |
| 8,433,083 | B2 | 4/2013 | Abolfathi | | |
| 8,480,176 | B2 | 7/2013 | Yamada | | |
| 2002/0076073 | A1 * | 6/2002 | Taenzer | H04R 25/502 | 381/315 |
| 2007/0189544 | A1 | 8/2007 | Rosenberg | | |
| 2007/0223720 | A1 * | 9/2007 | Goldberg | H04R 1/1041 | 381/74 |
| 2008/0049963 | A1 * | 2/2008 | Mann | H02J 7/0044 | 381/384 |
| 2008/0130906 | A1 * | 6/2008 | Goldstein | A61B 5/121 | 381/58 |
| 2008/0267416 | A1 * | 10/2008 | Goldstein | H04R 1/1091 | 381/56 |
| 2009/0010447 | A1 * | 1/2009 | Waite | G10K 11/1788 | 381/71.6 |
| 2009/0034748 | A1 | 2/2009 | Sibbald | | |
| 2013/0202131 | A1 * | 8/2013 | Kemmochi | H03G 3/00 | 381/104 |

FOREIGN PATENT DOCUMENTS

| | | |
|---|---|---|
| WO | WO 02100287 A2 | 12/2002 |
| WO | WO 2009135674 A1 | 11/2009 |
| WO | WO 2010107528 A3 | 4/2011 |
| WO | WO 2011129934 A2 | 10/2011 |

* cited by examiner

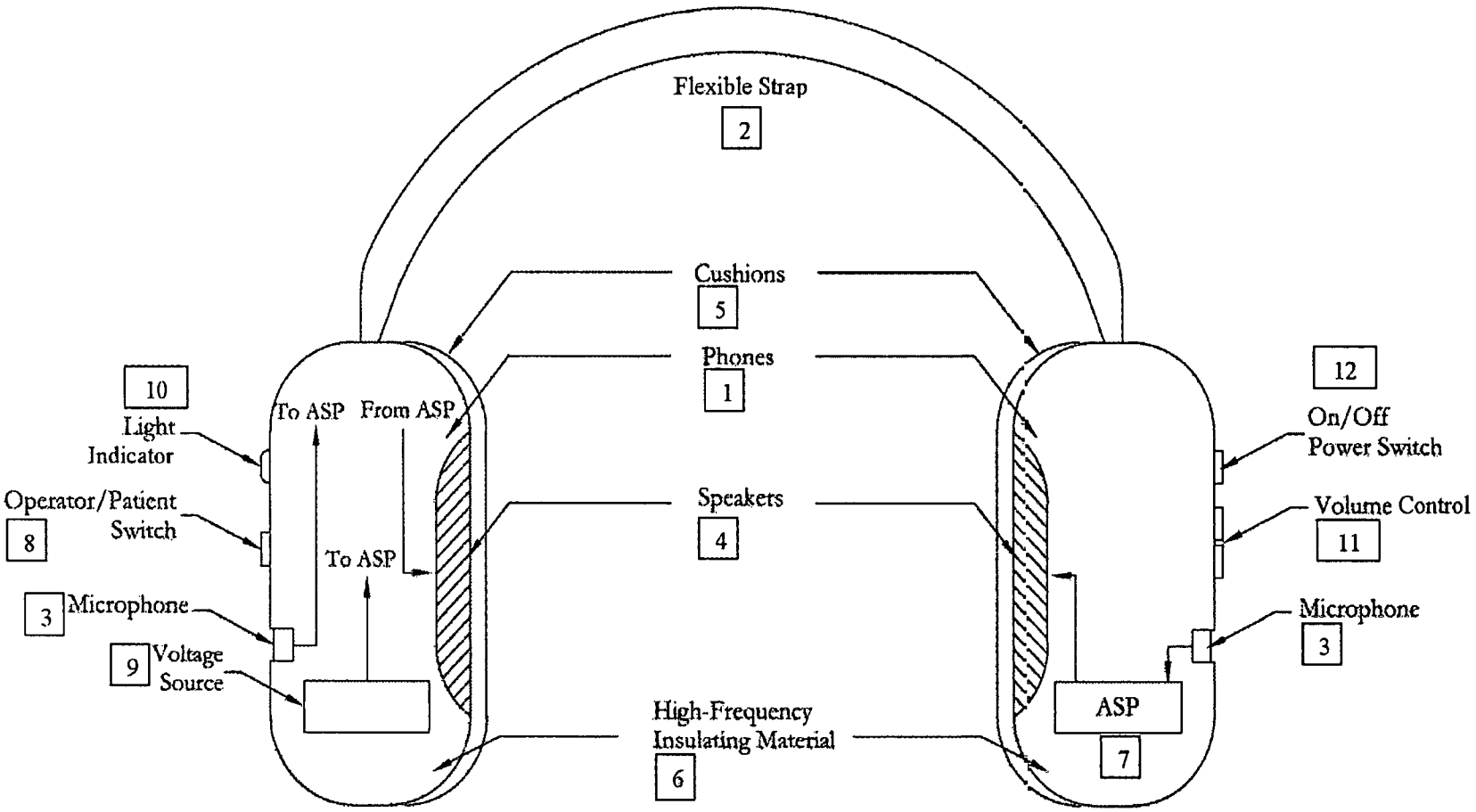
Figure 1: Front View of the Pair of Headphones

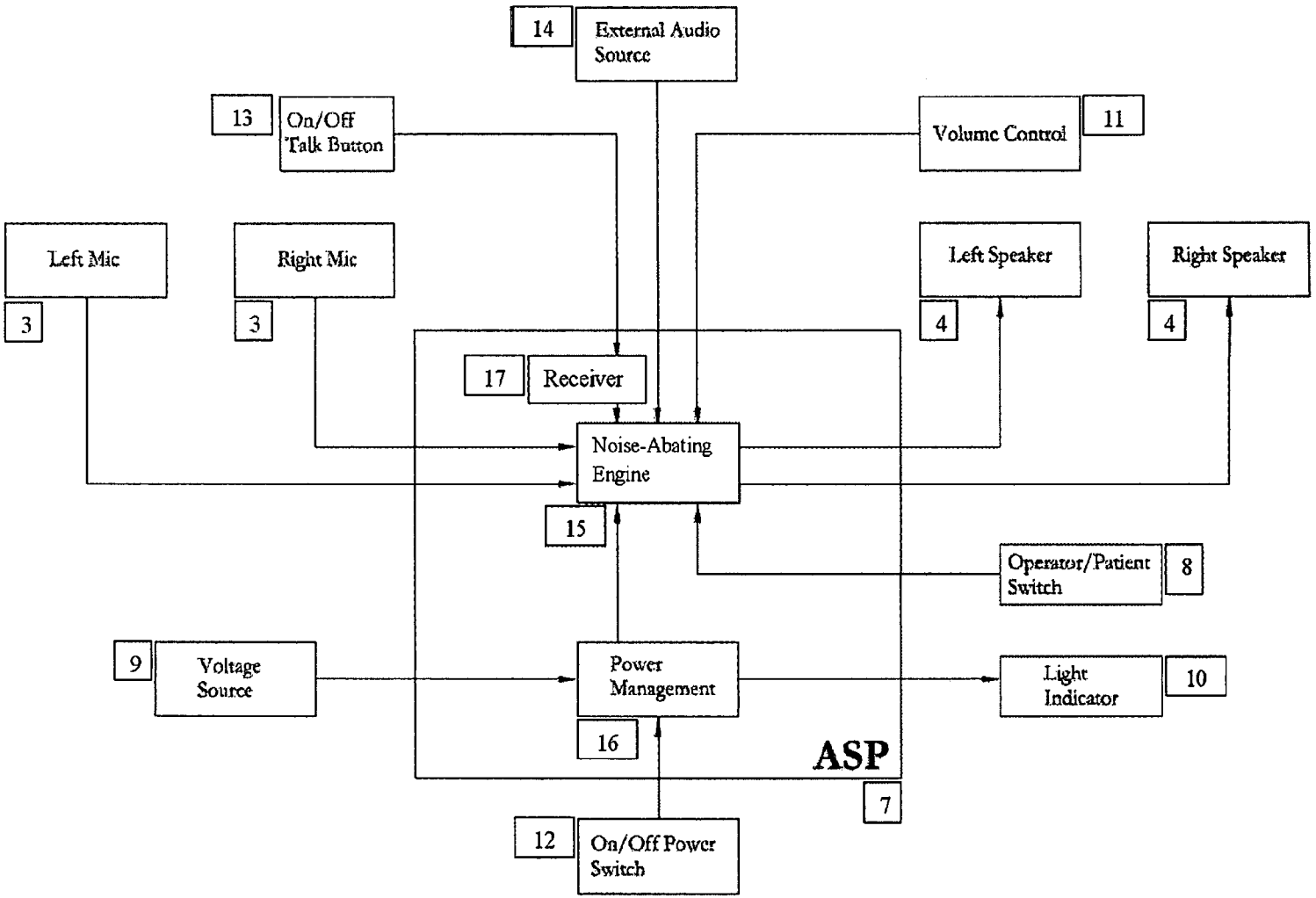
Figure 2: Block Diagram of the Audio Signal Processor (ASP)

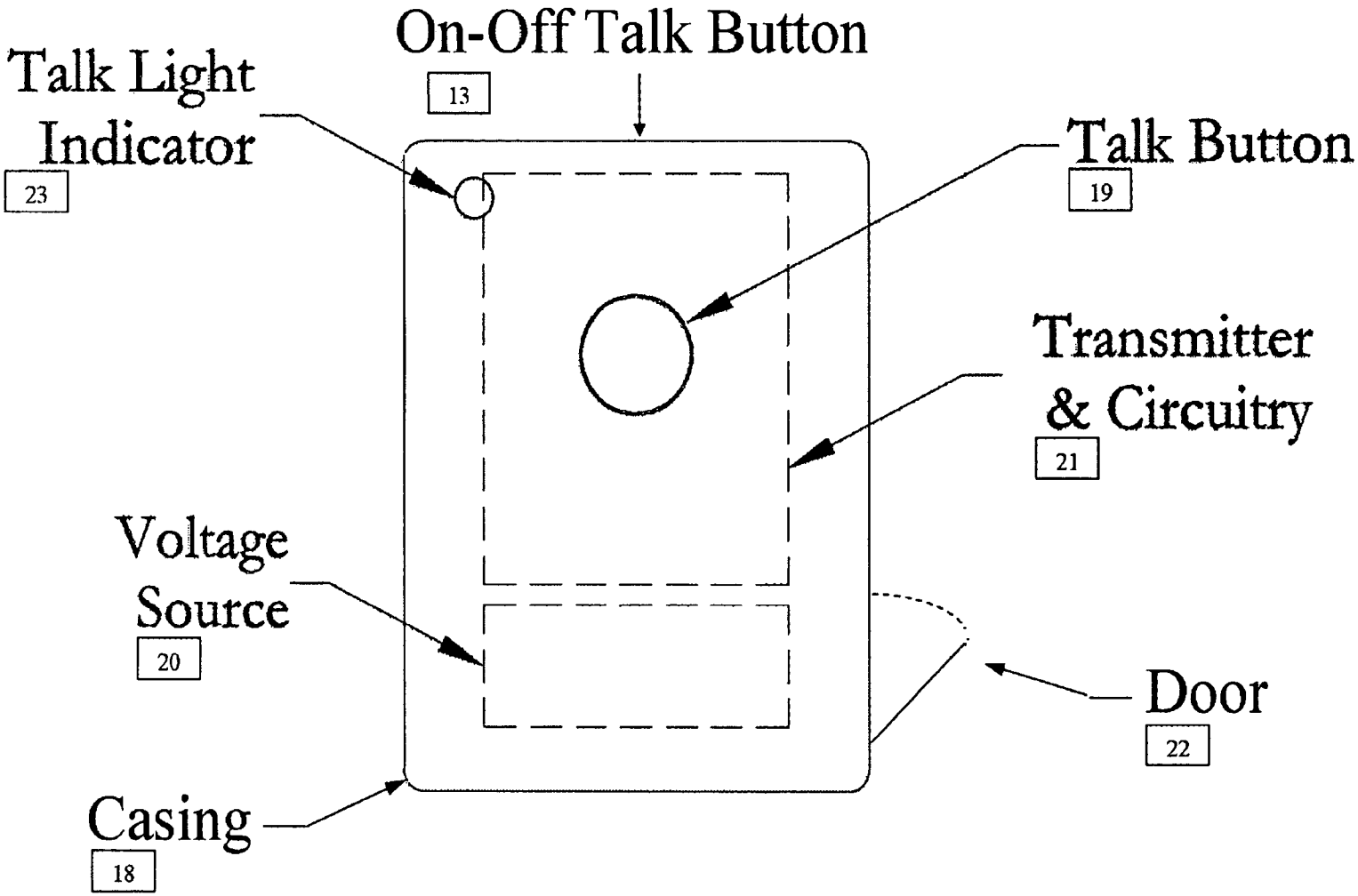
Figure 3 - Top View of the On-Off Talk Button

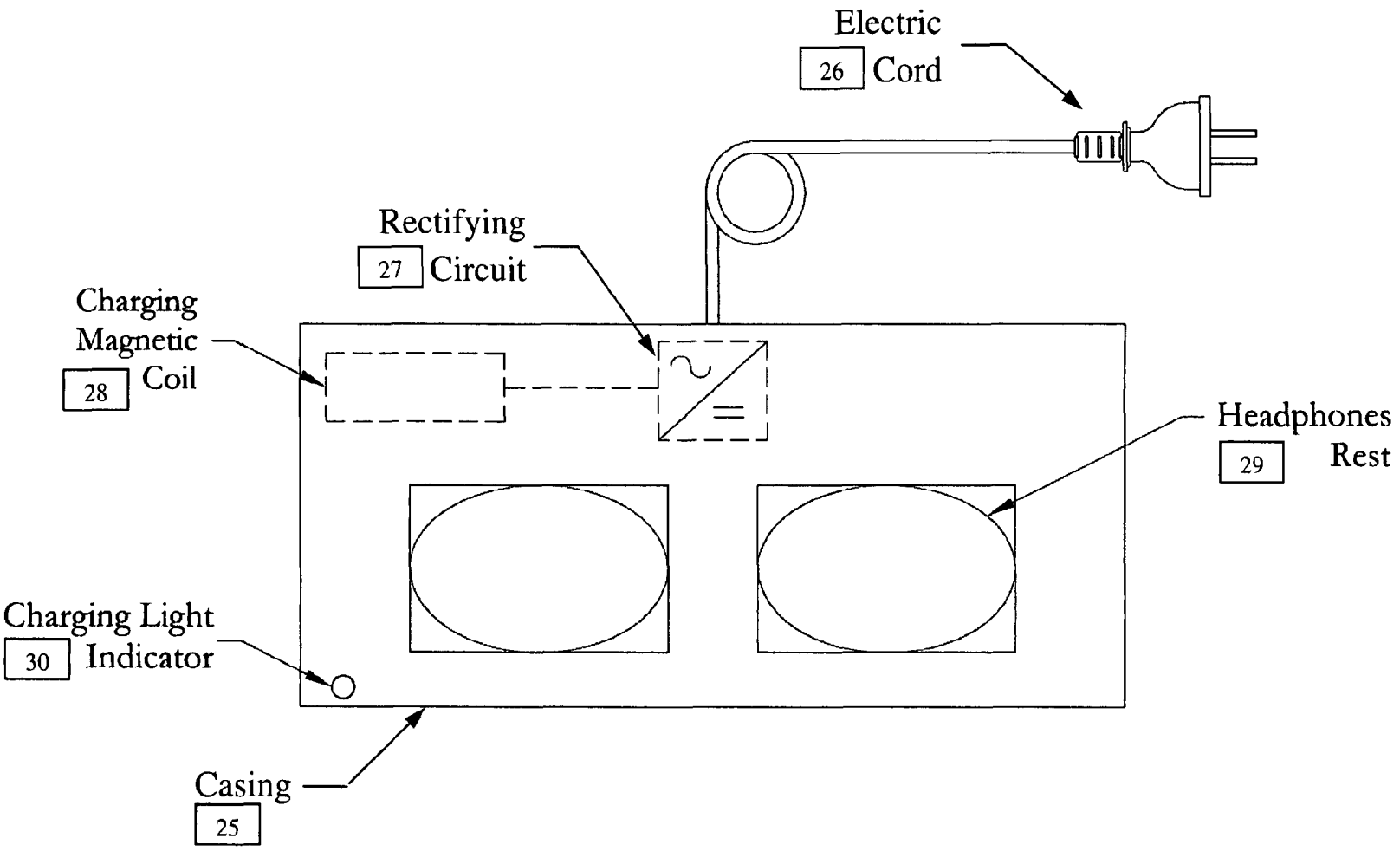
Figure 4 - Top View of the Charging Station

NOISE ABATEMENT SYSTEM FOR DENTAL PROCEDURES

CROSS-REFERENCE TO RELATED APPLICATIONS

This application claims the benefit of provisional patent application No. 61/883,199, filed 2013 Sep. 27 by inventors Peman Montazemi and Massimo Mitolo.

FEDERALLY SPONSORED RESEARCH

Not Applicable

SEQUENCE LISTING OR PROGRAM

Not Applicable

BACKGROUND

Field of Invention

This invention relates to a headphones system, specifically to such system which is used in dental procedures by dental staff members comprised of office managers and dental operators, and patients to abate noise from dental tools and other apparatus present in dental operatories, while allowing communication among dental staff members and between dental operator and patients.

Prior Art

This invention consists of a pair of headphones specifically designed for dental procedures, which usually employ dental tools generating high-frequency noise, which may harm dental staff members, as well as patients. Dental procedures can be noisy due to the nature of dental tools. This constant high-frequency noise can affect the hearing capability of any dental staff member and can also be non-compliant with OSHA and NIOSH regulations regarding the maximum permissible noise exposure levels for workers in a dental facility. Over time, this noise can cause irreversible hearing loss, as well as psychological stress, to dental staff members, with serious negative effects on their quality of life and performance. In addition, this harsh environment can make patients uncomfortable, even fearful, as they are normally awake during dental procedures. A healthier environment for both dental staff members and patients can be reached by providing shielding from the noise generated by dental tools; this shielding can be achieved by using the presented pair of headphones, actively and passively abating the high-frequency noise generated by dental tools, but yet allowing the recognition of speech among dental staff members, and between dental operators and patients. The pair of headphones also allows the introduction of auxiliary audio signals including at least one of music, soothing sounds, white noise, radio, TV and/or any audio signal generated by an external audio source, with a calming or distracting effect for patients of any age.

Current use of various acoustic techniques has so far failed to provide a quiet environment for both dental staff members and patients. Various high-frequency noises generated by dental tools including at least one of dental drills, suction system, air compressors, water pick, ultrasonic scaler, and similar apparatus are variable in frequency such that pitch gets higher or lower, in amplitude such that noise gets louder or quieter, and in direction such that dental operators, patients and/or dental tools are moved in space and in time. On one hand, dental tools cannot get any quieter and on the other hand, current acoustic technologies can hardly abate the high-frequency noise generated during dental procedures.

U.S. Pat. No. 2,986,140 to Gardner et al. (1961) shows a system for noise abatement of dental procedures that is designed to relieve a patient's pain and discomfort, and, more particularly, to an effective producer of analgesic or anesthetic action resulting from a particular utilization of audible sounds. While this system provides means of relieving a patient's pain and discomfort, it does not provide such noise-abating means or communication means to dental staff members, nor allows dental operators and patients to communicate without hearing the high-frequency noise generated by dental tools.

Both U.S. Pat. No. 4,977,600 to Ziegler (1990), W.O. Pat. No. 2002/100287 A2 to Saban and Zilberman (2002) and U.S. Pat. No. 5,133,017 to Barnes, Cain, Chait and Dye (1992) show noise suppression systems for personal/patient seat. These seats have a pair of noise-suppressing speakers placed in the headrest of the chair which, based on the noise coming from the surrounding environment, generate a noise-suppressing signal that creates a quiet zone in the space surrounding the ears of the user/patient. While both systems provide a quiet zone to patients, neither are suited to provide a quiet zone for dental staff members. Similar patents are: U.S. Pat. No. 8,130,987 to Kaneda, Kishi and Shiina (2012) and U.S. Pat. No. 8,480,176 to Yamada (2013). In addition, for all the above patents, the effective communication with the patients is not allowed.

E.P. Pat. No. 0438384 A1 to Ambrosio (1991) shows a dentist chair with an earpiece sound diffusion system. This sound diffusion system comprises a music player therewith an amplifier and sound level adjusting unit. The sound diffusion system is associated with the dentist chair so that the earpieces are arranged on two sides of a headrest of the chair and provide music to the patient during the dental procedure. However, this system does not provide any sound diffusion to dental staff members nor it presents any active means of high-frequency noise suppression for the benefit of both dental staff members and patients, such as playing music to the patient does not guarantee that the high-frequency noise generated by dental tools will be cancelled.

U.S. Pat. No. 5,692,056 to Gardner (1997) and U.S. Pat. No. 6,466,673 to Hardy (2002) show an intracranial noise suppression apparatus. These devices cancel the part of the noise that is emitted to the auditory nerve via conduction through the cranial bones. While these devices may eliminate a portion of the noise coming from dental tools transmitted to the patient through bone conduction, they fail to cancel the noise transmitted to both the dental staff members and patients through the air. Another similar patent is U.S. Pat. No. 8,433,083 to Abolfathi and Spiridigliozzi (2013).

U.S. Pat. No. 5,737,433 to Gardner (1998) shows a sound environment control apparatus which allows a user, by operating a remote control unit, to selectively suppress any of all of multiple noises in his or her environment, or selectively listen to any of these while suppressing all other sounds. This apparatus requires the user to place sound detectors at each interfering sound source that the user may wish to be able to control, meaning to suppress or enhance. However, this system is not practical as no object, such as a sound detector, can be placed near the various sound sources present in dental operatories. These sound sources correspond to the dental drill, the suction system, and similar apparatus, which are all employed to the area of the mouth of the patient, which is a confined space with low visibility and does not allow for any additional device, but dental tools to be present.

U.S. Pat. No. 6,118,878 to Jones (2000) shows an active noise cancellation system for headphones with strategic microphone placement to detect a signal more similar to that incident upon the eardrum of the user. While this system provides more effective noise cancellation and improved stability, it does not allow communication among dental staff members and between dental operators and patients while in use.

U.S. Pat. No. 6,728,385 to Kvaløy, Ottesen, Henriksen, Stensby, Sørsdal, Pettersen and Svean (2004) and U.S. Pat. No. 7,246,058 B2 to Burnett (2007) show a voice detection system and discrimination system. While both devices provide efficient means to detect voice, the first device must be worn in an in-ear fashion, which is not practical and uncomfortable for both dental staff members and patients if worn for prolonged periods of time, besides being non-compliant with OSHA regulations about hygiene and cross-contamination; the second patent requires not one, but two microphones to calculate the difference in signal gain between portions of the received acoustic signals, which increases the complexity of the system, thus decreasing its reliability. A similar patent is U.S. Pat. Appl. Pub. No. 2007/0189544 to Rosenberg (2007).

U.S. Pat. No. 6,975,158 to Sekimoto (2005) shows a noise canceling circuit that uses a low-pass filter to eliminate high-frequency component contained in an input signal. While this method is effective in canceling high-frequency components of narrow and wide widths, it fails to cover all audible high-frequencies of variable amplitude in time and coming from various directions, such as the high-frequency noise generated by dental tools.

U.S. Pat. No. 7,003,099 to Zhang and Pai (2006) shows a system that cancels acoustic echo and suppresses noise. While an array microphone combined with signal processing can be effective in removing echo and suppressing noise in communication systems and voice recognition devices, it cannot be used in the dental operatory, as the head of operators and patients should be placed between the microphones of the array microphone, which would block the beam formed by the array microphone to function normally. Similar patents to this invention are: U.S. Pat. No. 6,738,482 to Jaber (2004), U.S. Pat. No. 7,403,608 to Auvray, Le Tourneur and Thomas (2008), U.S. Pat. No. 7,415,372 to Taenzer and Spicer (2008) and U.S. Pat. No. 8,315,400 to Goldstein, Usher, Boillot and McIntosh (2012).

U.S. Pat. No. 7,171,008 to Elko (2007) shows a method to reduce noise in audio systems which can be used to reduce turbulent wind-noise resulting from wind or other airjets blowing across the microphones. While this method is useful at reducing wind noise, such noise type is not present in a typical dental operatory.

U.S. Pat. No. 7,215,766 to Wurtz (2007) shows a headset with auxiliary input jack(s) for cell phone and/or other devices. While this active noise reduction system provides means for successfully integrating more than one audio source, such as a primary input signal and an auxiliary audio signal, the latter requires an auxiliary port for connection to an output of at least one device. The invention herein presented does not require any port of connection to receive the auxiliary audio signal from an external audio source. This action is done remotely.

D.E. Pat. No. 102007054051 to Schmitt-Bylandt and Tannhauser (2009) shows a method for reducing anxiety and stress of patient during dental treatment. This system is conceived to reduce anxiety by displaying an image of the patient's mouth to him/her; this solution can be counterproductive, meaning to increase the patient's anxiety instead. Additionally, the background noise is not abated, but only attenuated.

U.S. Pat. Application No. 2008/0267416 A1 to Goldstein et al. (2008) and U.S. Pat. No. 7,817,803 to Goldstein (2010) shows methods and devices for hearing damage notification and intervention. This method monitors hearing health and includes: a first acoustic sound pressure level due to an ambient audio signal; a second acoustic sound pressure level due to an emitted audio signal from a speaker; finally calculates a total sound pressure level dosage and sending a notification signal when total sound pressure level dosage is greater than a threshold value. While this system may be useful in a dental operatory, it does not allow dental staff members to communicate among each other, or dental operators and patients to communicate with each other in a high-frequency noise-free environment. A similar patent is U.S. Pat. No. 8,218,784 to Schulein, Shaw and Brown (2012).

U.S. Pat. No. 7,970,159 to Kleinschmidt, Pavlotsky and Sapiejewski (2011) shows a noise reducing headset with a pair of earcups among other components; one of the earcups has a battery door that may be opened to allow insertion and removal of the battery and covered by a yoke assembly when the headset is worn by the user, with the battery fully seated in the earcup. While this headset system offers a list of components similar to the presented invention, it fails to have a voltage source that is rechargeable. Additional patents related to the active noise reduction technique are: U.S. Pat. No. 7,277,722 to Rosenzweig (2007), U.S. Pat. Appl. Pub. No. 2009/0034748 to Sibbald (2009), W.O. Pat. 2009/135674 to O'loughlin (2009), W.O. Pat. No. 2010/107528 to Pan (2010), U.S. Pat. No. 8,073,150 to Joho and Carreras (2011), W.O. Pat. No. 2011/129934 to Hopkins (2011), U.S. Pat. No. 8,189,803 to Bergeron, Crump and Gauger (2012) and U.S. Pat. No. 8,194,873 to Pan, Cheng and Salvador (2012). The active noise reduction technique has proven to work only on cyclic low-frequency noise, such as an airplane engine or ambient noise. Dental tools generate high-frequency noise, which cannot be eliminated using this technique.

U.S. Pat. No. 8,077,874 to Sapiejewski (2011) shows an active noise cancellation system for headphones with strategic microphone placement to improve phase margin in the feedback circuit. The headset system uses active noise reduction technique which again, is primarily known to work on low-frequency cyclic noise but, not on high-frequency non-cyclic noise such as the one generated by dental tools. The presented invention uses a combination of active and passive high-frequency noise abatement instead.

"Hearing Problems Among Dental Personnel" by Khalid A. Al Wazzan et al., JPDA Vol. 14 No. 4 October-December 2005 concludes that hearing problems among dental personnel are not of a severe nature, that hearing problems can happen due to dental field noise, that dental technicians are more prone to hearing problems than other dental personnel and that incidence of hearing problems increases with the increase of daily noise exposure. Their recommendations are that the dental field team should have ear protectors to reduce the hazards of dental field noise, particularly dental technicians and those who are exposed to dental noise for long periods daily. Therefore, the invention herein presented can be applicable to dental technicians as well.

SUMMARY

This invention, noise-abating headphones for dental procedures, is made of a left and a right phone connected to each other via a strap. Each phone carries a microphone that captures noise from the surrounding environment, transmits it to an audio signal processor (ASP), which filters out unwanted high-frequency noise coming from dental tools; the filtered audio signal is then sent into the ears of the user through a left and a right speaker mounted within the said phones. An operator/patient switch turns the headphones functionality between operator mode and patient mode. In the operator mode, the audio signal processor is turned on and abates high-frequency dental field noise produced by dental tools, and allows speech frequencies from the surrounding environment to be heard by the user. In patient mode, the audio signal processor is off unless an external operator (e.g. dentist, dental hygienist, dental assistant, dental technician and/or any other dental staff member in the dental operatory) switches a remote operator on/off talk button to the on position, in which case the patient can hear speech frequencies from the surrounding environment, but not the unwanted high-frequencies from dental field noise. In addition, in both operator and patient modes, the user of these headphones can mix in an auxiliary audio signal coming from an external audio source (e.g. music, soothing sounds, radio, TV or any external device capable of generating an audio signal). Still further advantages will become apparent from a study of the following description and the accompanying drawings.

DRAWINGS

Figures

FIG. 1: Front View of the Noise-Abating Headphones
FIG. 2: Block Diagram of the Audio Signal Processor (ASP)
FIG. 3: Top View of the Operator On/Off Talk Button
FIG. 4: Top View of the Charging Station

REFERENCE NUMERALS

[1] Left and Right Phones
[2] Strap
[3] Left and Right Microphones
[4] Left and Right Speakers
[5] Left and Right Cushions
[6] High-Frequency Insulating Material
[7] Audio Signal Processor (ASP)
[8] Operator/Patient Switch
[9] Voltage Source of Pair of Headphones
[10] Light Indicator of Pair of Headphones
[11] Volume Control
[12] On/Off Power Switch
[13] Charging Coil of Pair of Headphones
[14] Operator On/Off Talk Button
[15] External Audio Source
[16] Noise-Abating Filter
[17] Power Management
[18] Receiver
[19] Casing of Operator On/Off Talk Button
[20] Talk Button
[21] Voltage Source of Operator On/Off Talk Button
[22] Transmitter and Circuitry
[23] Door
[24] Talk Light Indicator
[25] Casing of Charging Station
[26] Electric Cord
[27] Rectifying Circuit
[28] Charging Magnetic Coil
[29] Headphones Rest
[30] Charging Light Indicator

DETAILED DESCRIPTION

FIG. 1 displays a front view of the pair of noise-abating headphones comprising two phones [1] covering the ears of the user, one strap [2] mechanically connecting the phones, two external microphones [3], two internal speakers [4], two padded cushions [5], two phones containing high-frequency insulating material [6], one internal audio signal processor with associated circuitry [7], one operator/patient switch [8], one internal voltage source [9], one voltage source light indicator [10], one volume control [11], one on/off power switch [12] and one charging coil [13].

FIG. 2 displays a block diagram of the audio signal processor (ASP) [7] comprising all inputs/outputs as well as internal functional blocks. In operator mode, the audio signal processor receives audio inputs from the two microphones [3], applies adequate filtering [16] to abate the high-frequency noise from dental tools, and outputs audio signals in speech frequency range from the surrounding environment to the ears of the user through the two speakers [4]. In patient mode, the ASP [7] is turned off and no noise is passed in to the user's ears through the speakers [4]. However, an operator on/off talk button [14] turns on the ASP and enables the user to hear audio signals in speech frequency range from the surrounding environment. Both operator and patient modes allow an auxiliary audio signal coming from an external audio source [15] to be mixed in. When the operator on/off talk button is in the on position and the operator/patient switch is in patient mode, the auxiliary audio signal is muted. The ASP [7] also has a power management unit [17] capable of governing power logic among the voltage source [9], on/off power switch [12], noise-abating filter [16] and light indicator [10]. As part of its associated circuitry, the ASP [7] also has a receiver [18] capable of receiving a triggering signal from the operator on/off talk button [14] when this one is enabled.

FIG. 3 displays a top view of the operator on/off talk button [14] which comprises one casing [19], one on/off talk button [20], one voltage source [21], one transmitter with associated circuitry [22], one sliding door to change the voltage source [23] and a talk light indicator [24] that turns on every time the operator on/off talk button is enabled. The operator on-off talk button can be either mounted onto the dental chair and be pressed by the operators' fingers or can be mounted into a foot switch that can be pressed by the operators' foot.

FIG. 4 displays a top view of the charging station which comprises one casing [25], one electric cord [26], one rectifying circuit [27], one charging magnetic coil [28], a headphones rest [29] where the pair of headphones can be rested on for charging and a charging light indicator [30].

Operation

In operation, one uses the pair of noise-abating headphones (FIG. 1) with the operator/patient switch [8] in operator mode. In this mode, the operator can only hear audio signals in speech frequency range and the noise from various dental tools is abated.

In operation, one uses the pair of noise-abating headphones (FIG. 1) with the operator/patient switch [8] in patient mode. In this mode, the patient cannot hear any noise from the surrounding environment, especially the high-frequencies emitted from various dental tools. Also in this mode, an operator can press on a talk button [20] located on a remote operator on/off talk button [14] (FIGS. 2 and 3), which will enable the patient to hear audio signals in speech frequency range, but not the noise from various dental tools.

In both operator and patient modes, the user can mix in an auxiliary audio signal coming from an external audio source [15]. In patient mode, when the operator presses the talk button [20], the auxiliary audio signal is muted for both users. The user of this system can control the volume of the audio signals by using a volume control button [11].

In operation, the user can turn the pair of noise-abating headphones on or off by switching an on/off power switch [12].

Last, the pair of noise-abating headphones can be rested onto a charging station [25-30] (FIG. 4) to charge its voltage source [9] in case it has reached a low voltage level. When charging, the charging station's charging light indicator [30] turns red. When the voltage source [9] of the pair of noise-abating headphones (FIG. 1) is fully charged, the charging light indicator turns green.

The invention claimed is:

1. A headphone system for protecting people from high-frequency noises including higher, dental tool-ranged frequency noises generated by dental tools, the headphone system comprising:

a patient headphone comprising:

first and second earphones, each of the first and second earphones comprising a high-frequency insulating material passively abating the high-frequency noises;

a patient microphone connected to one of the first and second earphones and receiving environmental sound including the high-frequency noises and lower, speech-ranged frequencies and outputting an audio output signal corresponding to the environmental sound;

a patient speaker coupled to the one of the first and second earphones and directing sound into an ear of the patient wearing the patient headphone a patient input device operated by the patient and switchable between on and off states; and a dental operator input device operated by a dental operator and switchable between on and off states; and an audio signal processor (ASP) connected to the patient input device, to the dental operator input device, and to the patient headphone and receiving the audio output signal from the patient microphone, wherein the ASP filters the higher, dental tool-ranged frequencies from the audio output signal while passing the lower, speech-ranged frequencies in the audio output signal to generate a filtered output signal that is provided to the patient speaker to generate the sound to the ear of the patient when either of the patient input device and the dental operator input device is switched to the on state by either the patient or the dental operator and the ASP disables outputting any signal including the audio output signal from the patient microphone to the patient speaker when both of the patient and dental operator input devices are switched to the off state by the patient and by the dental operator.

2. The headphone system of claim 1, wherein the higher, dental tool-ranged frequencies are frequencies that are higher than a speech frequency range and are generated by at least one of a dental drill, suction system, air compressor, water pick, or ultrasonic scaler.

3. The headphone system of claim 1, wherein the patient headphone further comprises a casing comprising a first hole and a second hole; and wherein the patient microphone is positioned to receive the environmental sound through the first hole; and wherein the patient speaker is positioned to output the sound through the second hole.

4. The headphone system of claim 3, wherein the patient microphone, the ASP, and the patient speaker are mounted within the casing, the first earphone further comprising a cushion coupled to the casing.

5. The headphone system of claim 3, wherein the casing is coupled to the high-frequency insulating material.

6. The headphone system of claim 3, the casing comprises the high-frequency insulating material.

7. The headphone system of claim 1, additionally comprising an auxiliary signal source providing an auxiliary audio signal to the ASP, wherein, when the patient input device is in the on state, the ASP disables generation of an auxiliary output signal based on the auxiliary audio signal by muting the auxiliary audio signal.

8. The headphone system of claim 7, wherein the ASP generates a mixed audio output signal comprising a mix of the filtered output signal and the auxiliary audio signal.

9. The headphone system of claim 1, further comprising, a voltage source in a casing of the second earphone, the voltage source powering the patient microphone and the patient speaker.

10. The headphone system of claim 9, further comprising: a charging coil in the casing of the second earphone.

11. The headphone system of claim 1, wherein the second earphone comprises:

a second high-frequency insulating material configured to passively abate the high-frequency noises;

a second microphone positioned to receive environmental sound and configured to generate and provide a second audio signal to the ASP; and a second speaker coupled to the ASP.

12. The headphone system of claim 1, wherein:

the patient input device is a first switch coupled to a first casing of the second earphone.

13. The headphone system of claim 1, wherein the patient input device is an operator/patient switch and the on state is an operator mode and the off state is a patient mode, wherein the dental operator input device is an operator on/off talk button, and wherein the ASP activates the patient microphone when either the operator/patient switch is switched to the operator mode by the patient or the operator on/off talk button is switched to the on state by the dental operator.

14. A system for noise abatement, the system comprising:

a headphone comprising:

a patient headphone comprising:

a high-frequency insulating material passively abating high-frequency noises;

a patient microphone receiving environmental sound including higher, dental-tool-ranged frequencies and lower, speech-range frequencies and outputting an audio signal corresponding to the environmental sound; and a patient speaker directing sound into an ear of the patient wearing the patient headphone;

a patient input device operated by the patient and switchable between on and off positions;

a dental operator input device operated by a dental operator and switchable between on and off positions;

an audio signal processor ASP, couple to the patient headphone, the patient input device, and the dental operator input device, receiving the audio signal from the patient microphone and filtering from the audio signal, the higher, dental tool-ranged frequencies while passing the lower, speech-range frequencies in the audio signal from the patient microphone to generate a filtered audio output signal, and providing the filtered audio output signal to the patient speaker to generate sound when either one of the patient input device and the dental operator input device is switched to the on position by either the patient or the dental operator, wherein the ASP does not provide any audio signal, including the audio signal, from the patient microphone to the patient speaker when both of the patient and dental operator input devices are switched to the off position by the patient and by the dental operator.

15. The system of claim 14, further comprising an operator controller configured to transmit a control signal to the headphone in response to an activation of a pushbutton switch, wherein the dental operator input device is a pushbutton switch in a dental office, a dental chair, or a foot switch.

16. The system of claim 15, further comprising a charging station comprising:

an electrical cord;

a rectifying circuit configured to receive electricity through the electrical cord;

a magnetic coil coupled to the rectifying circuit; and a headphone rest near the magnetic coil;

wherein the charging station recharges a voltage source in the patient headphone when the patient headphone is positioned on the headphone rest.

17. The headphone system of claim 14, wherein the patient input device is an operator/patient switch and the on position of the operator/patient switch is an operator mode position and the off position of the operator/patient switch is a patient mode position, wherein the dental operator input device is an operator on/off talk button, and wherein the ASP activates the patient microphone when either the operator/patient switch is switched to the operator mode position by the patient or the operator on/off talk button is switched to the on position by the dental operator.

18. A headphone system for protecting people from high-frequency noises including higher, dental tool-ranged frequencies generated by dental tools, the headphone system comprising:

a patient headphone comprising:

a first casing comprising high-frequency insulating material passively abating the high-frequency noises;

a first microphone coupled to the first casing and receiving environmental sound including the higher, dental tool-ranged frequencies and lower speech-range frequencies to output an audio signal corresponding to the environmental sound;

a first speaker coupled to the first casing, the first speaker generating sound based, at least in part, on a first output signal;

a dental operator headphone comprising:

a second casing comprising high-frequency insulating material passively abating the high-frequency noises;

a second microphone coupled to the second casing and receiving environmental sound;

a second speaker coupled to the second casing;

an audio signal processor (ASP) coupled to the patient headphone and configured to receive a first audio signal from the first microphone;

a patient switch coupled to the ASP, operated by the patient, and switchable between on and off states;

a dental operator switch coupled to the ASP, operated by a dental operator, and switchable between on and off states;

wherein the ASP generates the output signal including the first output signal by abating the higher, dental tool-ranged frequencies from the audio signal outputted from the first microphone and passing the lower, speech-range frequencies in the audio signal outputted from the first microphone when either one of the patient switch and the dental operator switch are switched to the on state by either the patient or the dental operator and does not provide any signal including the audio signal outputted from the first microphone to the first speaker when both of the patient and dental operator switches are switched to the off state by the patient and the dental operator.

* * * * *